United States Patent [19]

Mizutani et al.

[11] Patent Number: 4,801,778

[45] Date of Patent: Jan. 31, 1989

[54] CONDENSATION RESISTANT ELECTRODE FOR USE IN A DIELECTRIC HEATING APPARATUS

[75] Inventors: Isao Mizutani, Nagoya; Akio Enomoto, Chita, both of Japan

[73] Assignee: NGK Insulators, Ltd., Nagoya, Japan

[21] Appl. No.: 66,506

[22] Filed: Jun. 26, 1987

Related U.S. Application Data

[63] Continuation of Ser. No. 835,364, Mar. 3, 1986, Pat. No. 4,692,581.

[30] Foreign Application Priority Data

Mar. 12, 1985 [JP] Japan ..... 60-34064

[51] Int. Cl.[4] ..... H05B 6/54

[52] U.S. Cl. ..... 219/10.81; 165/168

[58] Field of Search ..... 219/10.81, 10.65, 10.49 R, 219/10.47, 10.491; 165/168, 171, 175; 34/1

[56] References Cited

U.S. PATENT DOCUMENTS

| | | | |
|---|---|---|---|
| 2,188,625 | 1/1940 | Dufour et al. | 219/10.65 X |
| 2,747,646 | 5/1956 | Lippman | 219/10.81 X |
| 3,444,275 | 5/1969 | Willett | 219/10.81 X |
| 4,257,167 | 3/1981 | Grassman | 219/10.81 X |
| 4,352,709 | 10/1982 | Urai et al. | 219/10.81 X |
| 4,427,865 | 1/1984 | Watanabe | 219/10.81 X |
| 4,692,581 | 9/1987 | Mizutani et al. | 219/10.81 |

*Primary Examiner*—Philip H. Leung

*Attorney, Agent, or Firm*—Parkhurst, Oliff & Berridge

[57] ABSTRACT

A dielectric heating apparatus comprising a pair of oppositely located electrodes is disclosed. In this apparatus, a passage for a heated fluid is arranged in the interior of at least one of the electrodes, whereby condensation at the electrode surface can be prevented effectively.

4 Claims, 2 Drawing Sheets

CONDENSATION RESISTANT ELECTRODE FOR USE IN A DIELECTRIC HEATING APPARATUS

This is a continuation of application Ser. No. 835,364 filed Mar. 3, 1986, U.S. Pat. No. 4,692,581, Sept. 8, 1987.

BACKGROUND OF THE INVENTION

1. Field of the Invention

This invention relates to a dielectric heating apparatus comprising a pair of opposed electrodes, at least one of which is provided with a heating means for the prevention of condensation.

2. Related Art Statement

Heretofore, dielectric heating apparatuses have been utilized for drying moisture-containing articles such as green ceramic products and the like as disclosed, for example, in Japanese Patent Application Publication No. 59-8,955.

In this case, as shown in FIG. 4, a pair of opposed flat plate electrodes 2 and 3 are arranged in parallel with each other so as to sandwich a belt of a belt conveyor 1 therebetween at proper intervals, and a high frequency voltage is applied across the electrodes 2 and 3 to conduct dielectric heating of articles 4 to be dried on the belt, whereby water contained in the article 4 is evaporated therefrom. A numeral 5 represents a duct for discharging vapor generated from the article.

However, when the article containing a large amount of water is subjected to the dielectric heating as mentioned above, vapor generated from the article is frequently cooled by contacting with the surfaces of the upper and lower electrodes to cause condensation at the electrode surface. Particularly, water droplets which condense on the upper electrode hang down therefrom, and consequently a concentration of electric field often occurs between the droplet and the article to cause electric discharge. By such an electric discharge, the article may be burnt or damaged.

In order to prevent the above mentioned condensation at the electrode surface, there have hitherto been proposed countermeasures, including a heater element of nichrome wire being embedded in the electrode, hot air being blown from the outside to the electrode, a hygroscopic porous plate being mounted onto the electrode, and so on. However, in the first countermeasure, the complete area of the electrode can not uniformly be heated, and also the disconnection of the nichrome wire is apt to result. In the second countermeasure, the article to be dried is heated in addition to the electrode, so that the article can not be dried uniformly. In the third countermeasure, the electrode must be made large-size, or the hygroscopic porous plate hangs down from the electrode in use so as not to hold a flat plate shape and peeling may result owing to the service life of the hygroscopic porous plate itself.

SUMMARY OF THE INVENTION

It is, therefore, an object of the invention to solve the aforementioned problems of the conventionally well-known countermeasures in the dielectric heating apparatus.

According to the invention, there is a provision of a dielectric heating apparatus comprising a pair of electrodes opposing each other, and a means for the passage of a heated fluid arranged in the interior of at least one of the electrodes.

In the invention, the electrode is uniformly heated from its interior by flowing the heated fluid from the outside into the means for the passage of the heated fluid, whereby condensation at the electrode surface can be prevented. Further, there is no fear of disconnection as in the case of using the nichrome wire, and it is not necessary to mount a separate member, such as a hygroscopic porous plate or the like, to the electrode.

BRIEF DESCRIPTION OF THE DRAWINGS

The invention will be described with reference to the accompanying drawings, wherein.

DESCRIPTION OF THE PREFERRED EMBODIMENTS

Figure 1:
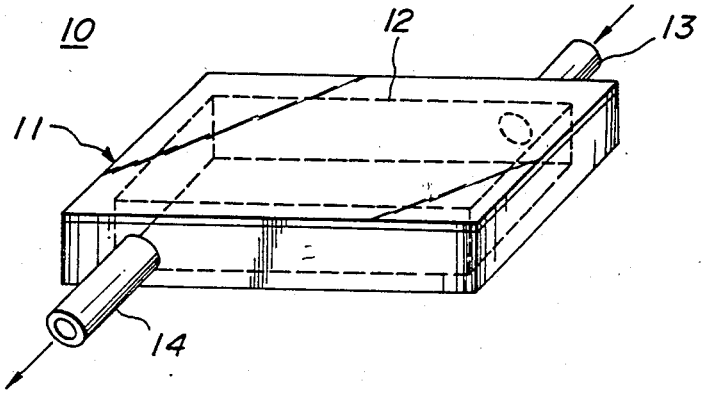
FIGS. 1 to 3 are perspective views of embodiments of the electrode used in the dielectric heating apparatus according to the invention, respectively.

In FIG. 1 is shown a first embodiment of the invention.

Figure 4:
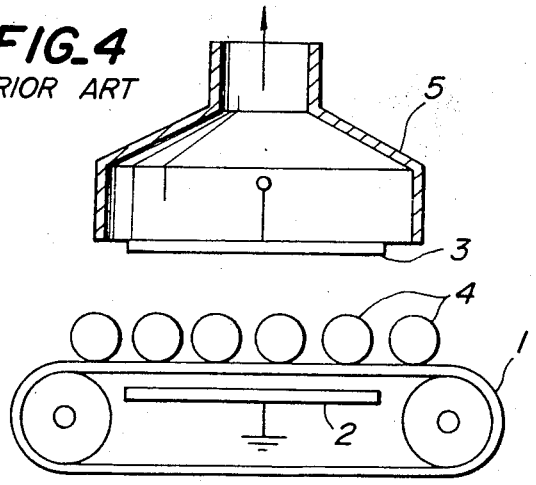
FIG 4 PRIOR ART
FIG. 4 is a schematic view of an embodiment of the dielectric heating apparatus.

An electrode 10, shown in FIG. 1, is one of to a pair of electrodes 2 and 3 in the dielectric heating apparatus shown in FIG. 4. The other embodiments as mentioned later are also the same.

The electrode 10 has a flat plate shape similar to that of a conventional electrode, but comprises an electrode body 11 and a means 12 for the passage of a heated fluid formed in the interior of the electrode body as a box-like space (hereinafter referred to as a fluid flowing means), and is further provided on the opposite side faces of the electrode body near the different edges with an inlet which connects to a supply pipe 13 for the heated fluid and an outlet which connects to a discharge pipe 14, respectively.

In the first embodiment, the heated fluid is fed from an external fluid pump (not shown) provided with a heating device to the fluid flowing means 12 through the supply pipe 13. Then, the heated fluid which flows into the fluid flowing means 12 heats the electrode body 11 from its interior and is returned into a fluid tank (not shown) through the discharge pipe 14.

As the fluid, use may be made of any heatable fluids, an example of which includes hot air, hot water, steam, high temperature oil and the like.

The illustrated electrode 10 is simple in structure and can efficiently be heated from its interior at a uniform temperature distribution, and consequently the effect of preventing condensation at the electrode surface can be attained effectively.

Figure 2:
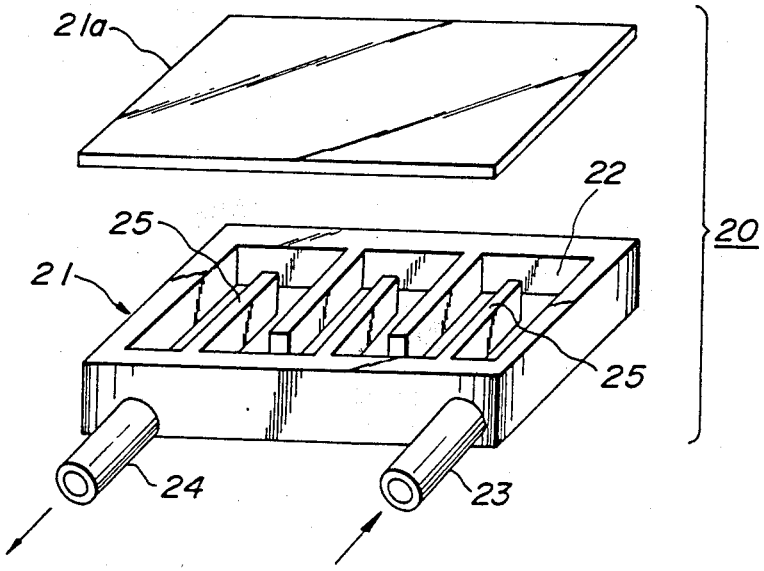

In FIG. 2 is shown a second embodiment of the invention, wherein an upper surface plate 21a is taken out from an electrode body 21 for clarifying the structure of the electrode body.

In the illustrated electrode 20, a box-like space is formed in the interior of the electrode body 21 having a flat plate shape. In this space are alternately and straightly extended a plurality of partition members 25 from opposite inner wall faces of the electrode body to form a multi-folded passageway as a means 22 for the passage of a heated fluid.

On the one side face of the electrode body 21 is provided an inlet for a supply pipe 23 and an outlet for a discharge pipe 24 at positions corresponding to both ends of the multi-folded passageway 22.

Even in the illustrated electrode 20, the heated fluid is fed from the outside through the supply pipe 23 into the interior of the electrode body and passes through the multi-folded passageway 22 to heat the electrode body from its interior in a manner similar to the first embodiment.

In the second embodiment, the means for the passage of the heated fluid is made into the multi-folded passageway, so that the heated fluid can efficiently be circulated over the whole area inside the electrode body 21, whereby the electrode surface can be heated more uniformly.

Although the inlet for the supply pipe 23 and the outlet for the discharge pipe 24 are located in the same side face of the electrode body in this embodiment, it is needles to say that they may be arranged on opposite side faces similar to the first embodiment.

Further, the partition member 25 may be curved so as to enhance the circulation efficiency, in addition to the straight shape which is shown.

Figure 3:
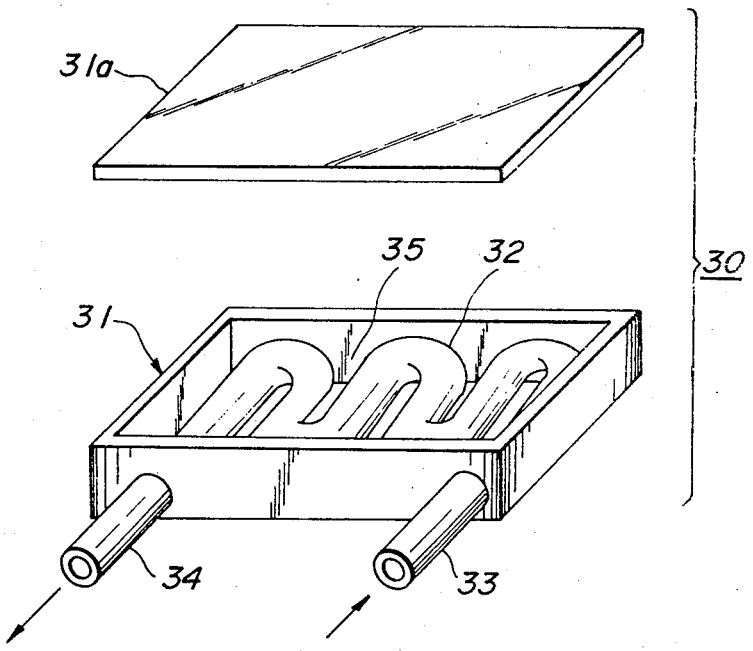

In FIG. 3 is shown a third embodiment of the invention. In this case, an upper surface plate 31a is taken out from an electrode body 31 for clarification of the structure.

An electrode 30 of the third embodiment has the same flat plate shape as in the first embodiment. The electrode body 31 constituting the electrode 30 is provided in its interior with a box-like space 35. In this space 35 is arranged a zigzag tube 32 as a means for the passage of a heated fluid.

Both ends of the zigzag tube 32 communicate with a supply pipe 33 and a discharge pipe 34 though an inlet and an outlet formed in the one side face of the electrode body 31, respectively.

In the third embodiment, the heated fluid is fed from the outside into the zigzag tube 32 through the supply pipe 33 and then discharged through the discharge pipe 34 to the outside.

Thus, the zigzag tube 32 is directly heated by the flowing heated fluid, and consequently the electrode body 31 is indirectly heated by a radiant heat generated from the heated zigzag tube 32. That is, the whole electrode surface of the electrode body 31 can uniformly be heated by the indirect heating based on the radiant heat even though the heated fluid does not spread over the whole area of the electrode body 31. Furthermore, even if the zigzag tube is damaged, there is caused no leakage of the heated fluid from the electrode body to the outside, so that the safety is considerably improved.

Although the invention has been applied to the rectangular flat plate electrode in all of the above embodiments, it is a matter of course that the invention can be applicable to flat plate electrodes having a different shape. In the latter case, the shape of the means for the passage of the heated fluid formed in the interior of the electrode body may properly be changed in accordance with the shape of the electrode to conduct the uniform heating of the electrode.

Moreover, the means for the passage of the heated fluid is sufficient to be arranged in an electrode liable to cause water condensation among the electrodes used in the dielectric heating apparatus. For instance, when a pair of electrodes are oppositely arranged in up and down directions with respect to the article to be dried, it is sufficient to form the above means in the upper electrode. On the other hand, when the opposite electrodes are arranged in right and left directions with respect to the article to be dried, the means for the passage of the heated fluid is formed in each of the electrodes.

Further, it is desirable that the surfaces of the opposed electrodes producing a dielectric field are made flat because the dielectric field distribution for the article to be dried is equalized and the heat is uniformly transmitted from the heated fluid.

As mentioned above, according to the invention, a means for the passage of a heated fluid is arranged in at least one of a pair of oppositely positioned electrodes for use in a dielectric heating apparatus, so that condensation at the electrode surface can be prevented by heating the electrode from its interior through the flowing heated fluid. Furthermore, there is caused no disconnection accident as in the conventional system using a nichrome wire heater, and there is no need for mounting a separate member such as hygroscopic porous plate or the like to the electrode surface.

What is claimed is:

1. A dielectric heating apparatus for drying an article containing excess water, comprising:

a pair of electrodes located spaced apart parallel to one another, such that said electrodes define an open dielectric heating zone and remain in a non-contacting relationship with said article, wherein at least one of said electrodes includes an interior box-like portion, said portion having a convoluted passageway formed therein by a plurality of alternately extending partition members, said partition members extending from opposed inner wall faces of said interior box-like portion;

means for introducing and discharging a heated fluid into and out of said interior portion, said fluid being restricted from entering said dielectric heating zone, such that said at least one of said electrodes including said interior box-like portion is heated by said heated fluid so as to prevent water vapor, exiting from said article, from condensing on said heated electrode; and means for supplying electrical power to said electrodes.

2. The dielectric heating apparatus according to claim 1, wherein said heated fluid is selected from the group consisting of hot air, hot water, steam and high temperature oil.

3. A method of heating at least one of two electrodes of a dielectric heating apparatus, said electrodes being located spaced apart parallel to one another, such that said electrodes define an open dielectric heating zone, comprising:

providing said at least one of two electrodes with an interior box-like portion;

forming a convoluted passageway in said interior box-like portion by providing a plurality of partition members alternately extending from opposed inner wall faces of said interior box-like portion; and introducing a heated fluid into said interior portion, said heated fluid being restricted from entering said dielectric heating zone, whereby said heated fluid heats said electrode and prevents the formation of condensation on a surface of said heated electrode.

4. The method according to claim 3, wherein said heated fluid is selected from the group consisting of hot air, hot water, steam, and high temperature oil.

* * * * *